US007476143B2

(12) United States Patent
Shibata

(10) Patent No.: US 7,476,143 B2
(45) Date of Patent: Jan. 13, 2009

(54) EYEGLASS LENS PROCESSING SYSTEM

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 36 days.

(21) Appl. No.: 11/649,787

(22) Filed: Jan. 5, 2007

(65) Prior Publication Data

US 2007/0202775 A1 Aug. 30, 2007

(30) Foreign Application Priority Data

Jan. 5, 2006 (JP) ..... P.2006-000949

(51) Int. Cl.
*B24B 49/00* (2006.01)
*B24B 51/00* (2006.01)

(52) U.S. Cl. ..... 451/5; 451/8; 451/10; 451/11; 451/43; 451/66; 451/71

(58) Field of Classification Search ..... 451/5, 451/8, 9, 10, 11, 43, 44, 65, 66, 67, 71; 340/680
See application file for complete search history.

(56) References Cited

U.S. PATENT DOCUMENTS

| | | | | |
|---|---|---|---|---|
| 5,967,879 | A * | 10/1999 | Gottschald | 451/5 |
| 6,220,929 | B1 | 4/2001 | Mizuno | |
| 6,328,630 | B1 * | 12/2001 | Jinbo et al. | 451/11 |
| 6,478,657 | B1 | 11/2002 | Shibata | |
| 6,572,460 | B2 * | 6/2003 | Mizuno | 451/178 |
| 6,623,339 | B1 * | 9/2003 | Igarashi et al. | 451/42 |
| 6,702,653 | B2 * | 3/2004 | Shibata | 451/42 |
| 6,749,377 | B2 * | 6/2004 | Gottschald et al. | 409/132 |
| 6,790,124 | B2 | 9/2004 | Shibata | |
| 7,281,967 | B2 * | 10/2007 | Meunier et al. | 451/5 |
| 2004/0097168 | A1 * | 5/2004 | Igarashi et al. | 451/5 |
| 2004/0192170 | A1 * | 9/2004 | Mizun | 451/5 |
| 2006/0140731 | A1 * | 6/2006 | Yamamoto et al. | 408/8 |
| 2006/0217036 | A1 * | 9/2006 | Meunier et al. | 451/5 |
| 2006/0240747 | A1 * | 10/2006 | Natsume et al. | 451/5 |

FOREIGN PATENT DOCUMENTS

EP 1 510 290 A1 3/2005

* cited by examiner

*Primary Examiner*—Timothy V Eley
(74) *Attorney, Agent, or Firm*—Sughrue Mion, PLLC

(57) ABSTRACT

An eyeglass lens processing system includes a main processing apparatus having a first lens chuck, a roughing tool, a first bevel-finishing tool, a lens edge measuring unit, and a first computing unit to obtain roughing data and first bevel-finishing data, and a sub processing apparatus, and having a second lens chuck, and a second bevel-finishing tool having a smaller diameter than the first bevel-finishing tool. The main processing apparatus has a means to set whether processing of the lens is performed by the first and second bevel-finishing tools, a transmission unit that transmits at least one of second bevel-finishing data or data for obtaining the second bevel-finishing data to the sub processing apparatus, a first control unit that performs roughing based on the roughing data and bevel-finishing based on the first bevel-finishing data. The sub processing unit has a second control unit that performs bevel-finishing based on the second bevel-finishing data.

5 Claims, 12 Drawing Sheets

EYEGLASS LENS PROCESSING SYSTEM

BACKGROUND OF THE INVENTION

The present invention relates to an eyeglass lens processing system for processing an eyeglass lens.

An eyeglass lens processing apparatus that processes an eyeglass lens generally has a basic configurations in which a edge position of the lens is measured on the basis of target lens shape data, roughing data and bevel-finishing data are obtained on the basis of data on the edge position, and roughing by a roughing tool and bevel-finishing by a bevel-finishing tool are performed while the lens is rotated. In recent years, with diversification of eyeglass frames, eyeglass frames in which a curve (hereinafter also referred to as frame curve) of a path of an inner bevel groove of a rim is sharp is have been increased. In order to comply with this, a curve (hereinafter also referred to as bevel curve) of a path of a bevel to be formed in the lens should also be made sharp. Thus, in order to process such a sharp bevel curve, an apparatus in which a processing unit having a bevel-finishing grindstone having a smaller diameter than a normal bevel-finishing grindstone having almost the same diameter as a roughing grindstone is further provided, and a lens is processed using the normal large-diameter bevel-finishing grindstone and the small-diameter bevel-finishing grindstone, which are separate from each other, according to the bevel curve value, is suggested (for example, refer to EP1510290A (JP-A-2005-74560)). Further, eyeglass frames without rims, such as a two point frame and a nylol frame, have also been increased. In order to comply with this, an apparatus in which a processing unit that drills the lens, a processing unit that grooves the lens, etc. are further provided is suggested (for example, refer to U.S. Pat. No. 6,790,124B (JP-A-2003-145328)).

However, if the processing unit including the small-diameter bevel-finishing tool (grindstone), the drilling processing unit, the grooving unit, etc. are added to the inside of the apparatus including the basic processing unit including the roughing tool (grindstone) and the normal large-diameter bevel-finishing tool (grindstone), the internal configuration of the apparatus becomes complicated and the apparatus becomes large. Further, if other processing units are required, a user who already has the apparatus including only the basic processing unit should purchase the apparatus including the other processing units as well. In such a case, although it is possible to comply with the requirement by preparing each dedicated unit separately, a measuring unit that measures the edge position of the lens, a display unit, an input unit, etc. will be redundant. Moreover, since entry work should be performed redundantly, the usability becomes bad, and the processing time also becomes long.

SUMMARY OF THE INVENTION

A technical object of the present invention is to provide an eyeglass lens processing system capable of systematizing various processing units to efficiently perform various kinds of processing, without complicating the internal configuration of an apparatus provided with a basic processing unit.

The present invention has the following configurations in order to solve the above object.

(1) An eyeglass lens processing system for processing an eyeglass lens, the system comprising:

a main processing apparatus including a first lens chuck that chucks the lens, a roughing tool, a first bevel-finishing tool, a lens edge measuring unit that obtains an edge position of the lens based on target lens shape data, and a first computing unit that obtains roughing data using the roughing tool and first bevel-finishing data using the first bevel-finishing tool; and a sub processing apparatus that is provided separately from the main processing apparatus and includes a second lens chuck that chucks the lens, and a second bevel-finishing tool having a smaller diameter than the first bevel-finishing tool, wherein the main processing apparatus includes:

a setting unit that sets whether processing of the lens is performed by the first or second bevel-finishing tool;

a transmission unit that, when the processing by the second bevel-finishing tool is set, transmits any of second bevel-finishing data using the second bevel-finishing tool and data for obtaining the second bevel-finishing data to the sub processing apparatus; and a first control unit that, when the processing by the first bevel-finishing tool is set, performs roughing based on the roughing data and bevel-finishing based on the first bevel-finishing data, and when the processing by the second bevel-finishing tool is set, performs only the roughing based on the roughing data, and wherein the sub processing unit includes a second control unit that, when the processing by the second bevel-finishing tool is set, performs bevel-finishing based on the second bevel-finishing data.

(2) The eyeglass lens processing system according to (1), wherein the transmission unit transmits any of data on the edge position and bevel path data based on the edge position data to the sub processing apparatus, and the sub processing apparatus includes a second computing unit that obtains the second bevel-finishing data based on the transmitted data.

(3) The eyeglass lens processing system according to (1), wherein the transmission unit transmits chucking pressure data of the first lens chucks to the sub processing apparatus when the processing by the second bevel-finishing tool is set.

(4) An eyeglass lens processing system for processing an eyeglass lens, the system comprising:

a main processing apparatus including a first lens chuck that chucks the lens, a roughing tool, a bevel-finishing tool, a flat-finishing tool, a lens edge measuring unit that obtains an edge position of the lens based on target lens shape data, and a first computing unit that obtains roughing data using the roughing tool, bevel-finishing data using the bevel-finishing tool, and flat-finishing data using the flat-finishing tool; and a sub processing apparatus that is provided separately from the main processing apparatus and including a second lens chuck that chucks the lens and a drilling tool, wherein the main processing apparatus includes:

a setting unit that sets whether or not drilling of the lens is performed;

a transmission unit that, when it is set that the drilling is performed, transmits any of drilling data using the drilling tool and data for obtaining the drilling data to the sub processing apparatus; and a first control unit that, when it is set that the drilling is performed, performs roughing based on the roughing data and flat-finishing based on the flat-finishing data, and wherein the sub processing unit includes a second control unit that, when it is set that the drilling is performed, performs the drilling based on the drilling data.

(5) The eyeglass lens processing system according to (4), wherein the transmission unit transmits chucking pressure data of the first lens chucks to the sub processing apparatus when it is set that the drilling is performed.

DESCRIPTION OF PREFERRED EMBODIMENTS

Figure 1:
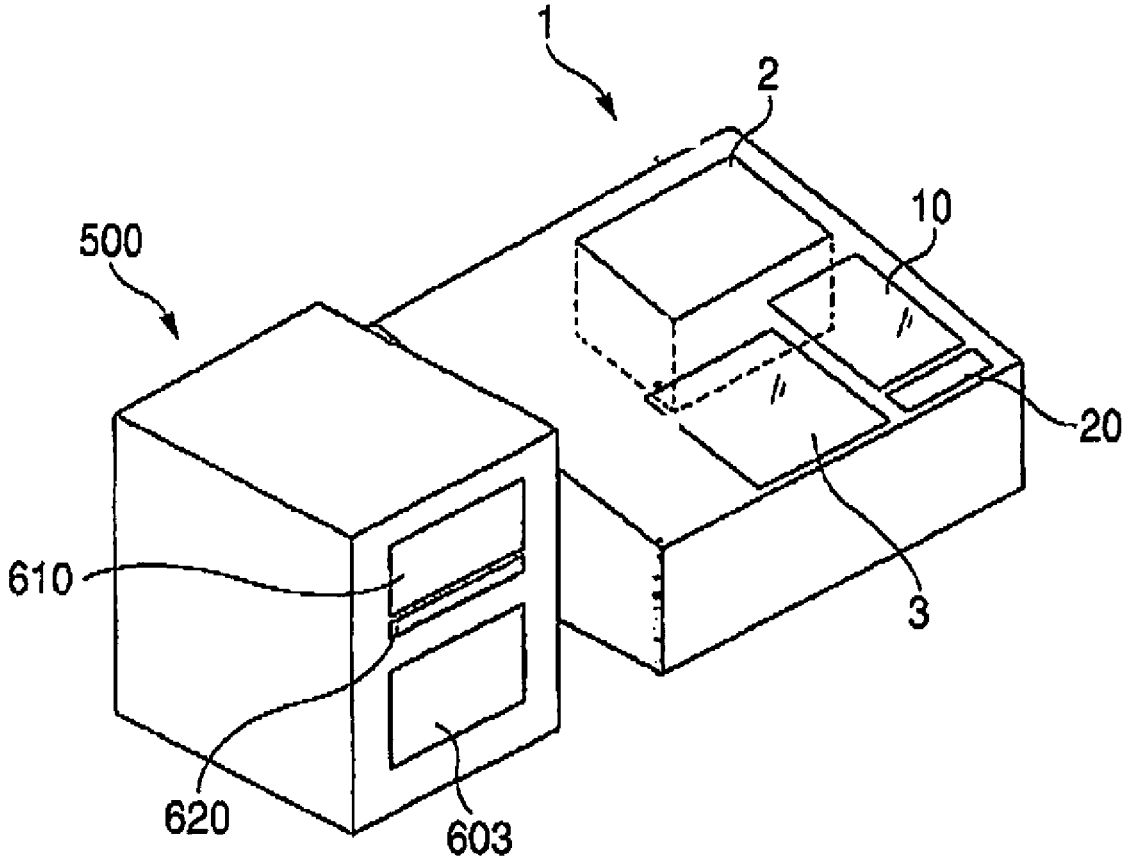
FIG. 1 is a view showing a schematic configuration of an eyeglass lens processing system that is an embodiment of the present invention.

Hereinafter, embodiments of the present invention will be described with reference to the accompanying drawings. FIG. 1 is a view showing a schematic configuration of an eyeglass lens processing system according to an embodiment of the present invention. A main processing apparatus 1 and a sub processing apparatus 500 are provided in separate housings, respectively. Further, the main processing apparatus 1 and the sub processing apparatus 500 can mutually transmit and receive data by cable communication or wireless communication.

(A) Configuration of Main Processing Apparatus

An eyeglass frame measuring device 2 are mounted in the main processing apparatus 1. Further, a touch panel type display 10 and a switch unit 20 having a processing start switch, etc. are arranged on a top face of a housing of the main processing apparatus 1. The display 10 has functions to input processing conditions, layout data, etc. using a touch panel. Reference numeral 3 represents a door of a processing chamber. In addition, the eyeglass frame measuring device 2, the display 10, and its input functions may be configured as units separated from the housing of the main processing apparatus 1.

Figure 2:
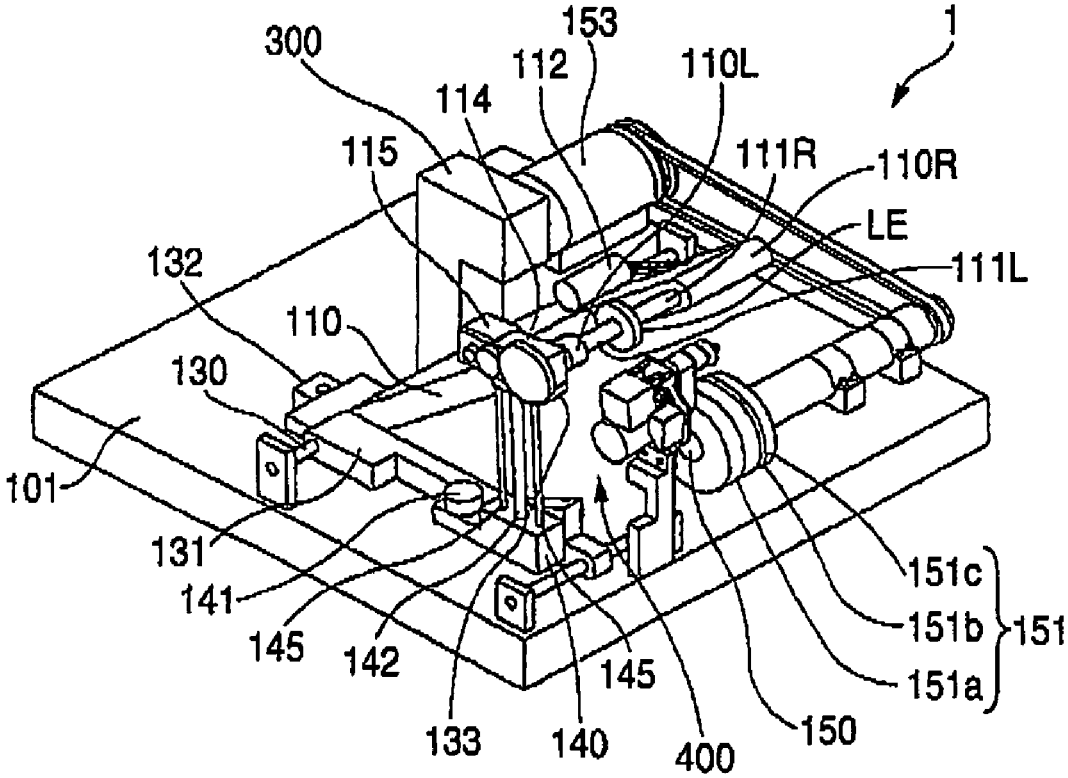
FIG. 2 is a view showing a schematic configuration of a processing unit of a main processing apparatus.

FIG. 2 is a view showing the schematic configuration of a processing unit of the main processing apparatus 1. A lens LE to be processed is chucked and held by two lens chucks 111R and 111L possessed by a carriage 110, and is processed by a grindstone 151 that is a processing tool to be attached to a grindstone spindle 150. The grindstone 151 is provided with three grindstones including a roughing grindstone 151*a* for plastic, a bevel-finishing grindstone 151*b*, and a bevel-polishing grindstone 151*c*. The grindstones 151*b* and 151*c* respectively have a V-groove for formation of a bevel and a flat processing surface. The grindstones 151*a*, 151*b*, and 151*c* have large diameters, and the diameters are about 100 to 120 mm. It is preferable that the diameter of the grindstone 151 be 60 mm or more in order to extend the lifespan against wear. The grindstone spindle 150 rotates by a motor 153 through a rotation transmission mechanism, such as a belt.

A motor-mounting block 114, which is rotatable about the axis of the lens chuck 111L held by a left arm 110 L of the carriage 110, is attached to the left arm 110L. This block 114 is provided with a lens-rotating motor 115, and the rotation of the motor 115 is transmitted to the lens chuck 111L via gears. Further, the rotation of the lens chuck 111L is transmitted to the lens chuck 111R held by a right arm 110R of the carriage 110 by a rotation transmission mechanism arranged inside the carriage 110, and accordingly, the lens chuck 111L and the lens chuck 111R are rotated in synchronization with each other. Further, a chucking block 112, which causes the lens chuck 111R to move in its axial direction, is attached to the right arm 110R of the carriage 110.

Figure 3:
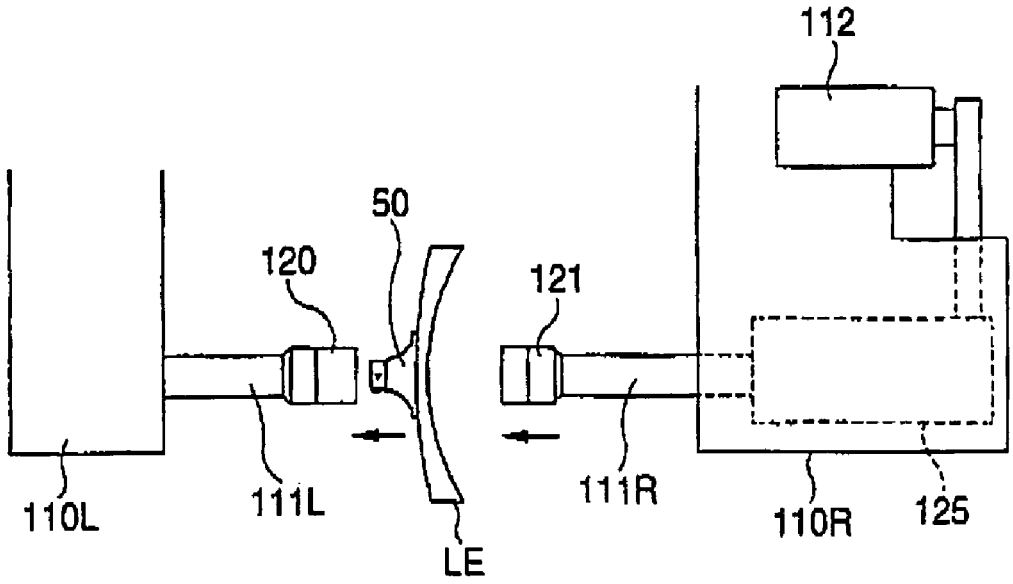
FIG. 3 is a view showing a schematic configuration of a lens chucking unit of the main processing apparatus.

FIG. 3 is a view showing the schematic configuration of a lens chucking unit of the main processing apparatus 1. During processing, a cup 50 that is a fixing tool is axially aligned and fixed to the front surface (anterior refractive surface) of the lens LE with adhesive tape, and a base of the cup 50 is mounted on a cup holder 120 possessed by the lens chuck 111L. A lens presser 121 is fixed to a front tip of the lens chuck 111R. The lens chuck 111R is held so that it can be moved towards the lens chuck 111L by a moving unit 125 arranged inside the right arm 110R of the carriage 110. The lens chuck 111R is moved in its radial direction via the moving unit 125 by the rotation of the motor 112. As the lens chucking unit, a widely known lens chucking unit that is described in U.S. Pat. No. 6,220,929B (JP-A-11-333685), etc. is used. When the lens chuck 111R is moved toward the lens chuck 111L, the lens LE is chucked via the cup holder 120 and the lens presser 121 by the two lens chuck 111L and 111R. The chucking pressure at this time is detected by a current that flows through the motor 112, and the chucking pressure is changed as a current is supplied according to a required chucking pressure.

Further, the carriage 110 is adapted to be rotatable and slidable with respect to a carriage shaft 130 parallel to the lens chucks 111L and 111R and is configured such that it is moved horizontally together with a movable arm 131 by a motor 132. A rocking block 140 is attached to the movable arm 131 so that it can rotate about an axis that coincides with the axis of the grindstone spindle 150. A lens-elevating motor 141 and a feed screw 142 are attached to the rocking block 140, and the rotation of the motor 141 is transmitted to the feed screw 142 via a belt, etc. A guide block 133 that abuts against a lower end surface of a motor-mounting block 114 is fixed to an upper end of the feed screw 142. The guide block 133 is moved along two guide shafts 145 implanted in the rocking block 140. The vertical position of the guide block 133 can be changed by the rotation the motor 141. The carriage 110 can be moved vertically with the carriage shaft 130 as its rotation center by the movement of the guide block 133. In addition, a spring (not shown) is stretched over between the carriage 110 and the movable arm 131, and thereby the carriage 110 is always biased downward to push the lens LE against the grindstone 151. As the carriage unit, a widely known carriage unit that is described in U.S. Pat. No. 6,478,657B (JP-A-2001-18155), etc can be used.

Figure 4:
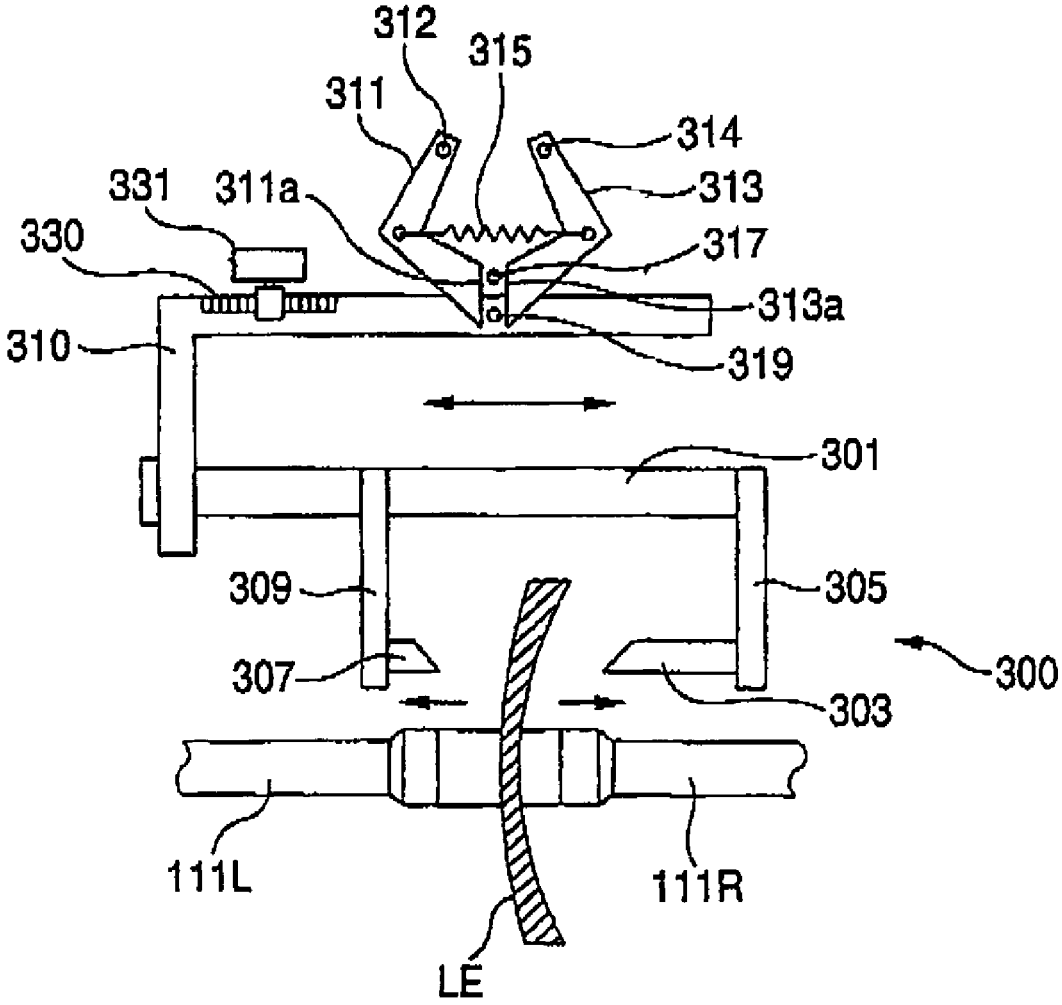
FIG. 4 is a view showing a schematic configuration of a lens measuring unit of the main processing apparatus.

A lens measuring unit 300 is arranged behind the carriage 110. FIG. 4 is a view showing the schematic configuration of the lens measuring unit 300 (a measuring unit of the edge position of a lens). An arm 305 with a measurement stylus 303 for measurement of a lens rear surface is fixed to a right end of a shaft 301. Further, an arm 309 with a measurement stylus 307 for measurement of a lens front surface is fixed to the center of the shaft 301. The axis that connects the point of contact of the measurement stylus 303 with the point of contact of the measurement stylus 307 is parallel to the axis of the lens chucks 111L and 111R. The shaft 301 is adapted to be movable in the axial direction of the lens chucks 111L and 111R integrally with a slide base 310.

The slide base 310 is provided with a rack 330 that extends horizontally, and the horizontal movement of the slide base 31020 is detected by an encoder 331 via the rack 330. Further, behind the slide base 310, a V-grooved driving plate 311 is provided-so as to be rotatable about a shaft 312, and an inverted V-grooved driving plate 313 is provided so as to be rotatable about a shaft 314. A spring 315 that biases the driving plate 311 and the driving plate 313 in a direction the driving plates are caused to approach each other is stretched between the driving plates. Further, a limiting pin 317 is provided between an end face 311*a* of the driving plate 311 and an end face 313*a* of the driving plate 313. When an external force is not applied to the slide base 310, both the end face 311*a* of the driving plate 311 and the end face 313*a* of the driving plate 313 are brought into abutment with the limiting pin 317, and this will become an origin of horizontal movement. Further, a guide pin 319 that touches the end face 311*a* of the driving plate 311 and the end face 313*a* of the driving plate 313 is anchored to the slide base 310. When the force that moves the slide base 310 rightward acts on the slide base 310, the guide pin 319 will move the end face 313*a* rightward. At this time, the slide base 310 is biased by the spring 315 in a direction in which it returns to an origin position. On the contrary, when the force that moves the slide base 310 leftward acts on the slide base 311, the guide pin 319 will move the end face 311*a* leftward. At this time, similarly, the slide base 310 is biased by the spring 315 in a direction in which it returns to an origin position. From such movement of the slide base 310, the movement distance of the measurement stylus 303 that contacts the rear surface of lens LE and the movement distance of the measurement stylus 307 that contacts the front surface of the lens LE are detected by the encoder 331. In addition, the shaft 301 is rotated around an axis by a motor (not shown), and the measurement styluss 303 and 307 are moved to a measuring position from a retreating position.

At the time of measurement of the shape of the front surface of the lens, the lens LE is moved leftward in FIG. 4, and thereby the measurement stylus 307 is brought into contact with the front surface of the lens LE. A force is applied to the measurement stylus 307 by the spring 315 so that the measurement stylus may always contact the front surface of the lens. In this state, the edge position of the front refractive surface of the lens LE is detected by the encoder 331 by moving the carriage 110 vertically according to vector information of a target lens shape while the lens LE is rotated. Similarly, at the time of measurement of the shape of the rear surface of the lens, the lens LE is moved rightward in FIG. 4, and thereby the measurement stylus 303 is brought into contact with the rear surface of the lens LE. The edge position of the rear refractive surface of the lens LE is detected by the encoder 331 by moving the carriage 110 vertically according to the vector information of the target lens shape while the lens LE is rotated.

Figure 5:
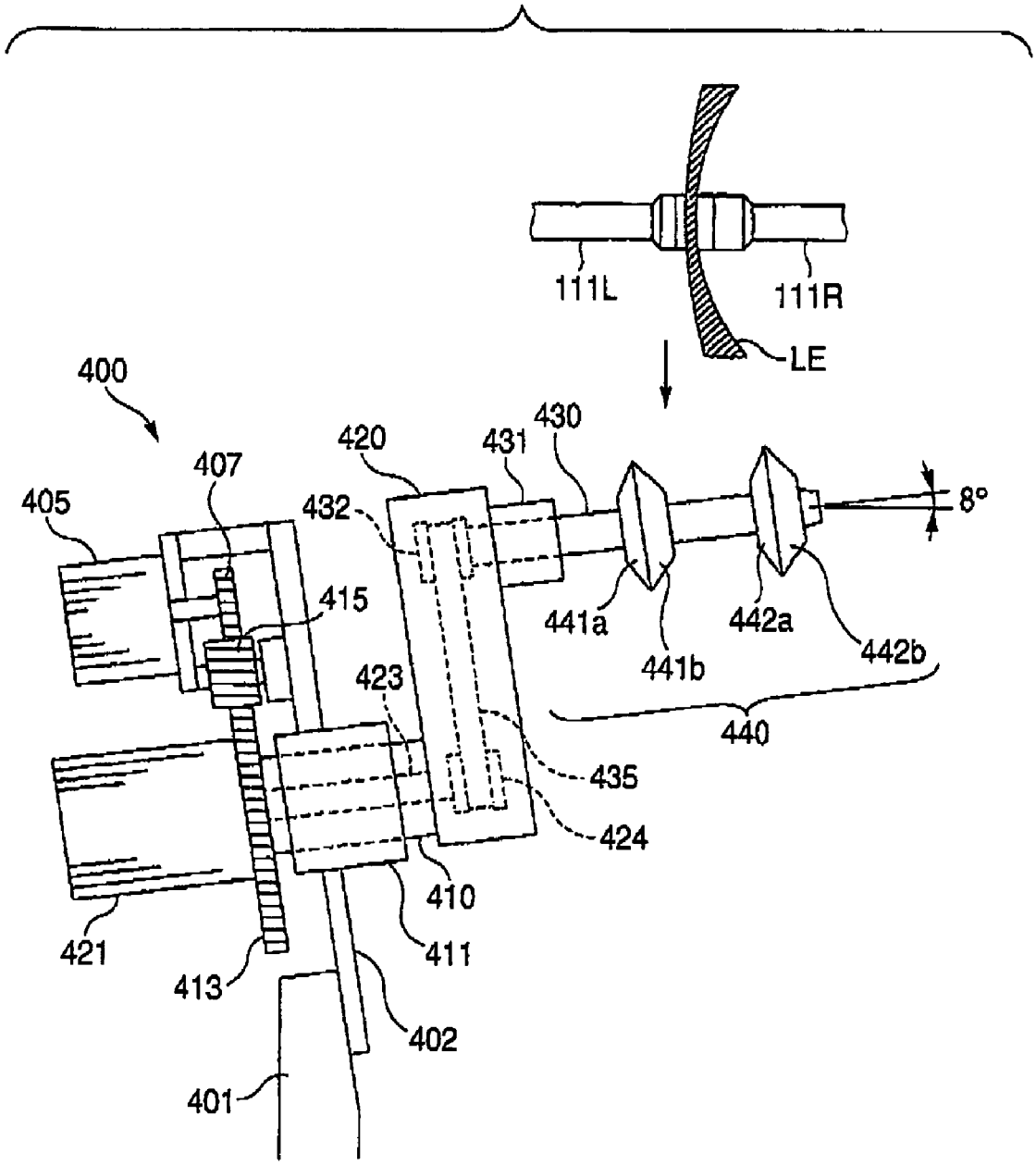
FIG. 5 is a view showing a schematic configuration of a chamfering unit of the main processing apparatus.

Referring to FIG. 2, a chamfering unit 400 is arranged at the near side of the main processing apparatus 1. FIG. 5 is a view showing the schematic configuration of the chamfering unit 400. A stationary plate 402 is fixed to a supporting block 401 (refer to FIG. 2) on a base 101. A pulse motor 405 for rotating an arm 420 to move a grindstone unit 440 between a processing position and a retreating position is fixed above the stationary plate 402. A holding member 411 that holds a arm rotating member 410 rotatably is fixed to the stationary plate 402, and a larger gear 413 is fixed to the arm rotating member 410 extending to the left of the stationary plate 402. A gear 407 is attached to a rotary shaft of the pulse motor 405. As a result, the rotation of the gear 407 by the pulse motor 405 is transmitted to the larger gear 413 via an idler gear 415 to rotate the arm 420 fixed to the arm rotating member 410.

A grindstone-rotating motor 421 is fixed to the larger gear 413, and the motor 421 rotates together with the larger gear 413. The rotary shaft of the motor 421 is connected with a shaft 423 that is rotatably held inside the arm rotating member 410. A pulley 424 is attached to a right end of the shaft 423 extended to the inside of the arm 420. The holding member 431 that holds a grindstone spindle 430 rotatably is fixed to a tip of the arm 420. A pulley 432 is attached to a left end of the grindstone spindle 430. The pulley 432 is connected with the pulley 424 by a belt 435, and thereby the rotation of the motor 421 is transmitted to the grindstone spindle 430. A finishing-chamfering grindstone 441*a* for the rear surface of a lens, a finishing-chamfering grindstone 441*b* for the front surface of the lens, a polishing-chamfering grindstone 442*a* for the rear surface of the lens, and a polishing-chamfering grindstone 442*b* for the front surface of the lens are fixed to the grindstone spindle 430. The grindstone spindle 430 is arranged in a posture inclined at an angle of 8 degrees with respect to the axial direction of the lens chucks 111L and 111R, and the grindstone unit 440 is adapted to run along the curve of a lens curve easily. The grindstones 441*a*, 441*b*, 442*a* and 442*b* are circular, and their outer diameter is about 30 mm.

At the time of chamfering, the arm 420 is rotated by the pulse motor 405, and the grindstone unit 440 is moved to a processing position from a retreating position. The processing position of the grindstone unit 440 is a position where the rotation axis of the grindstone spindle 430 is placed on a plane in which both the rotation axes is located between the lens chuck 111L or 111R and the grindstone spindle 150. Accordingly, similarly to the lens periphery processing by the grindstone 151, the center distance between the lens chuck 111L or 111R and the grindstone spindle 430 can be changed by the motor 141.

(B) Configuration of Sub Processing Apparatus

Referring to FIG. 1, a touch panel type display 610 and a switch unit 620 having a processing start switch, etc. are arranged on the front surface of the sub processing apparatus 500. The display 610 displays required information, such as processing information or maintenance information, and the display can input various kinds of setting depending on touch panel functions. Reference numeral 603 represents a door of a processing chamber.

Figure 6:
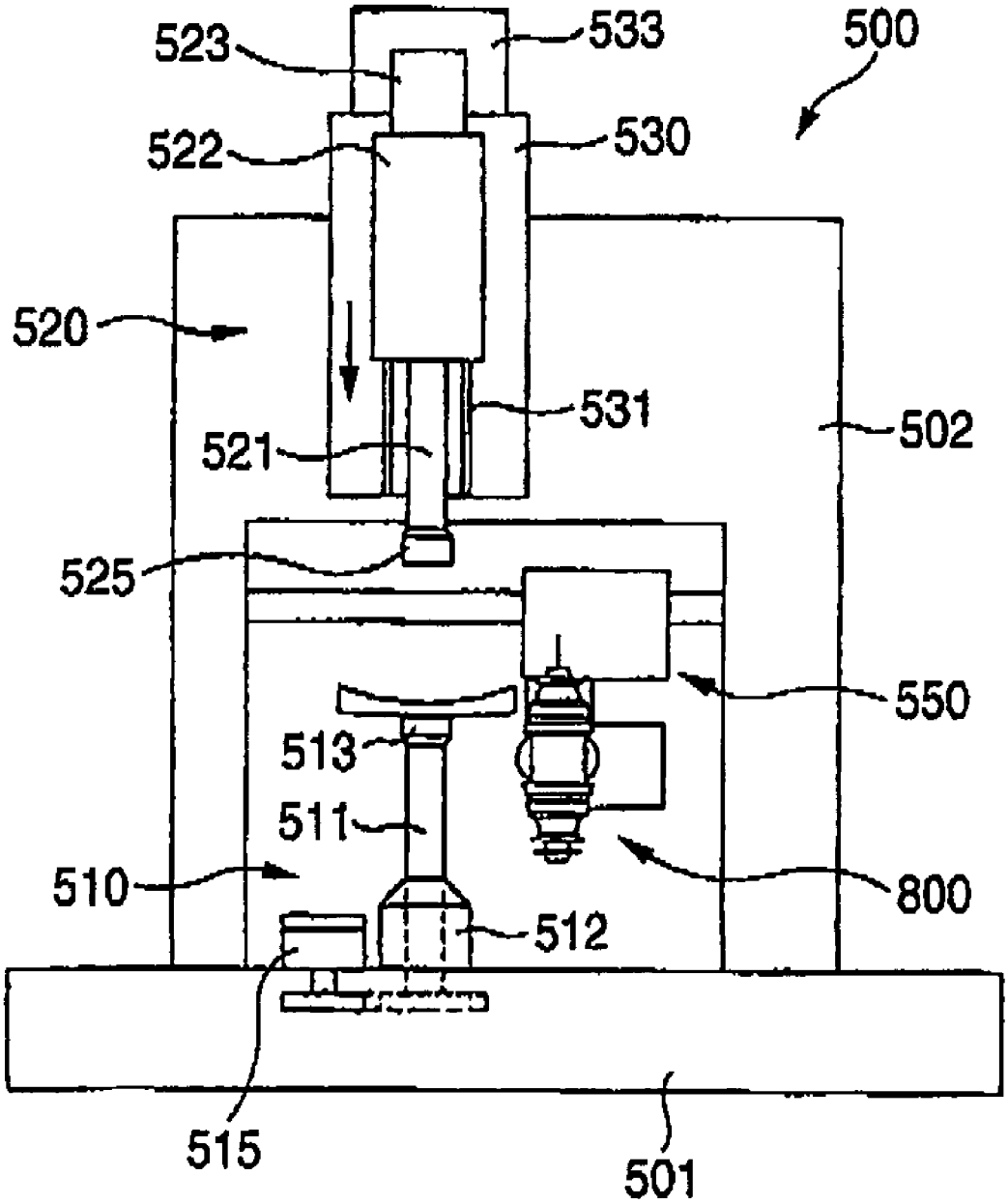
FIG. 6 is a view showing a schematic configuration of a lens chucking unit of a sub processing apparatus.

FIG. 6 is a view showing the schematic configuration of a lens chucking unit of the sub processing apparatus 500, and is a figure when the inside of the sub processing apparatus 500 is viewed from the front. A lens chucking unit 510 is provided in a base 501, and a lens chucking unit 520 is provided in a subbase 502 erected from the base 501. A lens LE is held by a lens chuck 511 of the lens chucking unit 510 and a lens chuck 521 of the lens chucking unit 520. The lens chuck 511 is rotatably provided by a holder 512 fixed to the base 501, and is rotated by a motor 515 via a rotation transmission mechanism, such as a gear. A cup holder 513 for allowing the base of a cup 50 fixed to the lens LE to be inserted thereinto is attached to an upper portion of the lens chuck 511.

The lens chuck 521 of the lens chucking unit 520 is rotatably held by a holder 522. A motor 523 that rotates the lens chuck 521 is provided in an upper portion of the holder 522. Further, a stationary block 530 is fixed above the subbase 502, and the holder 522 is attached to the front of the stationary block 530 so that it can move vertically along a slide rail 531. A motor 533 is attached to an upper portion of the stationary block 530, and the motor 533 moves the holder 522 vertically via a feed screw, etc. A lens presser 525 is attached to a lower end of the lens chuck 521. This lens presser 525 has the same shape as the lens presser 121 attached to the lens chuck 111R of the main processing apparatus 1. Further, the cup holder 513 also has the same shape as the cup holder 120 attached to the lens chuck 111R of the main processing apparatus 1, and the conditions at the time of lens chucking becomes the same as those in the case of the processing apparatuses 1. When the lens LE is chucked, the holder 522 is lowered by the motor 533. The chucking pressure at this time is adjusted by the motor and 533. As the motor 515 and the motor 523 rotate in synchronization with each other, the lens LE held by the lens chucks 511 and 521 is rotated.

Referring to FIG. 6, reference numeral 800 represents a processing unit having a bevel-finishing grindstone having a small diameter. The processing unit 800 is adapted to be movable vertically (z-direction) and horizontally (x-direction) by a vertical and horizontal movement unit 550.

Figure 7:
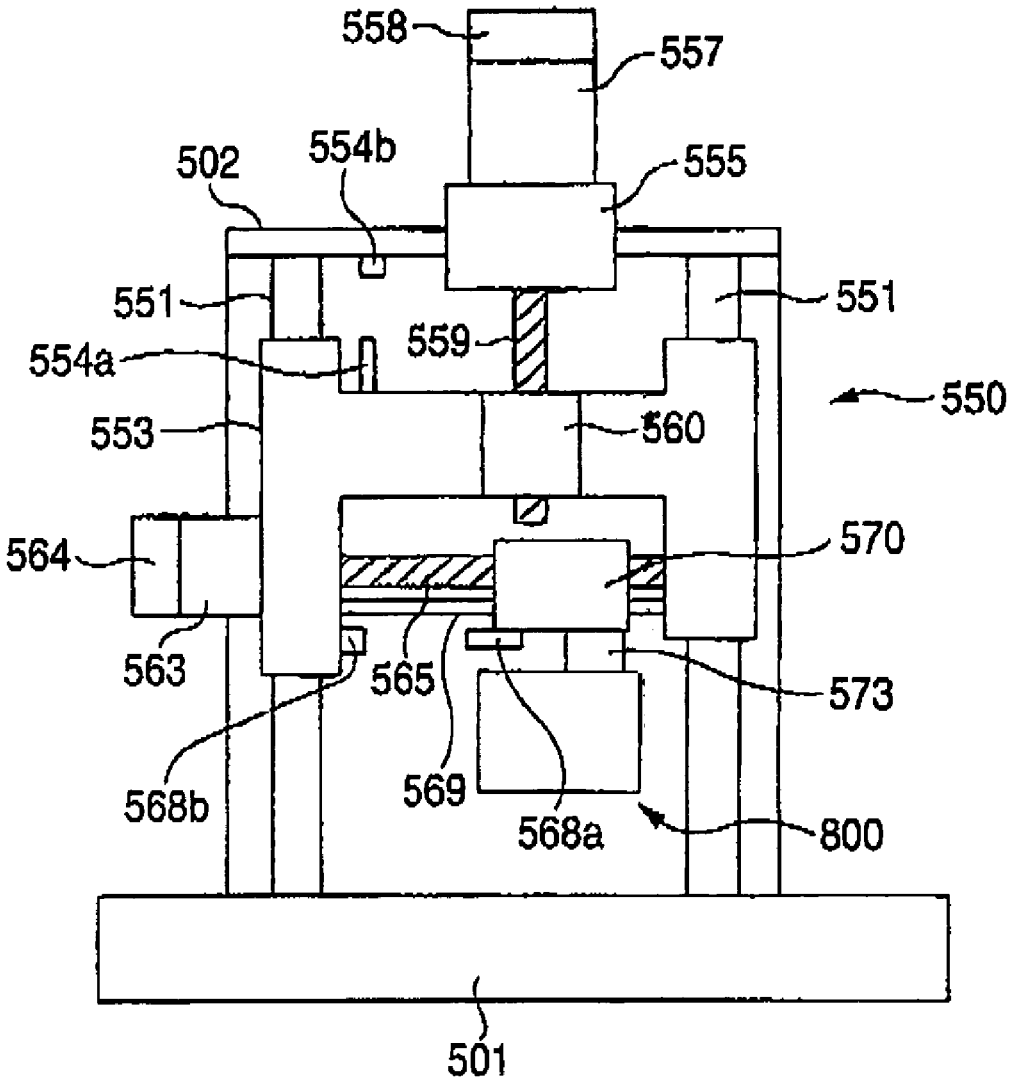
FIG. 7 is a view showing a schematic configuration of a vertical and horizontal movement unit of the sub processing apparatus.

FIG. 7 is a view showing the schematic configuration of the movement unit 550 of the sub processing apparatus 500, and is a figure when the inside of the sub processing apparatus 500 is viewed from the back. Two shafts 551 that extend vertically are erected from the base 501, and a vertical movement supporting base 553 is adapted to be movable along the shafts 551. A block 555 is fixed to an upper portion of the subbase 502, and a motor 557 for vertical movement is attached to an upper portion of the block 555. A feed screw 559 is connected to a rotary shaft of the motor 557. A nut block 560 is fixed to the top face of the vertical movement supporting base 553, and the vertical movement supporting base 553 is moved vertically along with the nut block 560 by the rotation of the feed screw 559.

Further, the motor 557 is provided with an encoder 558, and the vertical movement position of the vertical movement supporting base 553, i.e., the vertical position of the processing unit 800, is detected by the encoder 558. The vertical origin position of the processing unit 800 is detected by a light-shielding plate 554*a* fixed to the top face of the vertical movement supporting base 553, and a photosensor 554*b* fixed to the upper subbase 502 that faces the light-shielding plate 554*a*.

A motor 563 for horizontal movement is fixed to the vertical movement supporting base 553. A rotary shaft of the motor 563 is connected to a feed screw 565 that extends horizontally. When the feed screw 565 rotates, a horizontal movement block 570 formed with a feed nut is guided by a shaft 569 extending horizontally, and is moved horizontally. The processing unit 800 is attached to the horizontal movement block 570 by an mounting plate 573. The processing unit 800 is moved horizontally by rotating the motor 563 back and forth, and is moved vertically by rotating the motor 557 back and forth. Further, the motor 563 is provided with an encoder 564, and the horizontal movement position of the processing unit 800 is detected by the encoder 564. The horizontal origin position of the processing unit 800 is detected by a light-shielding plate 558*a* fixed to the horizontal movement block 570, and a photosensor 568*b* that faces the light-shielding plate 568*a* and is fixed to the vertical movement supporting base 553.

Figure 8:
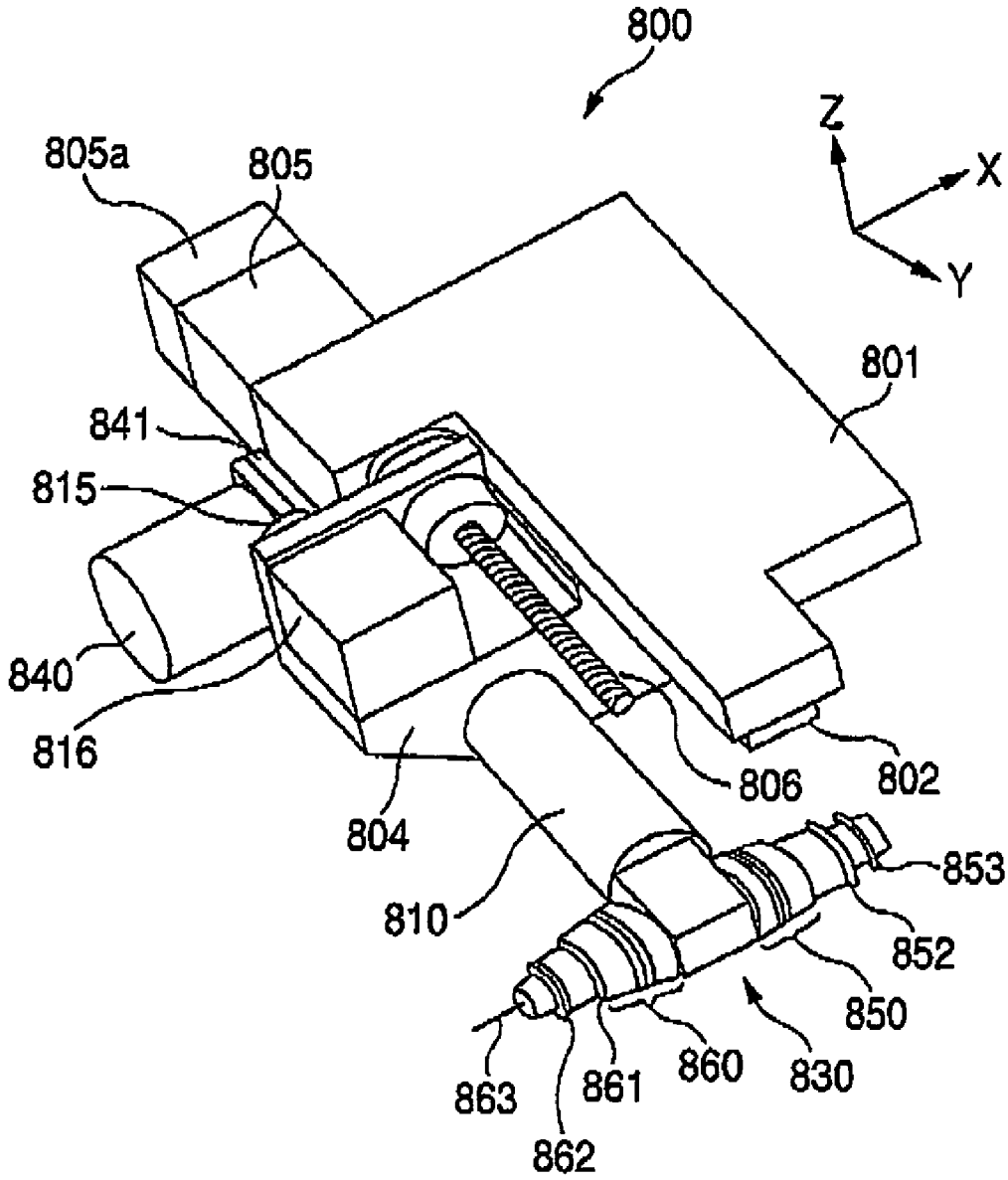
FIG. 8 is a perspective view of a processing unit of the sub processing apparatus.
Figure 9:
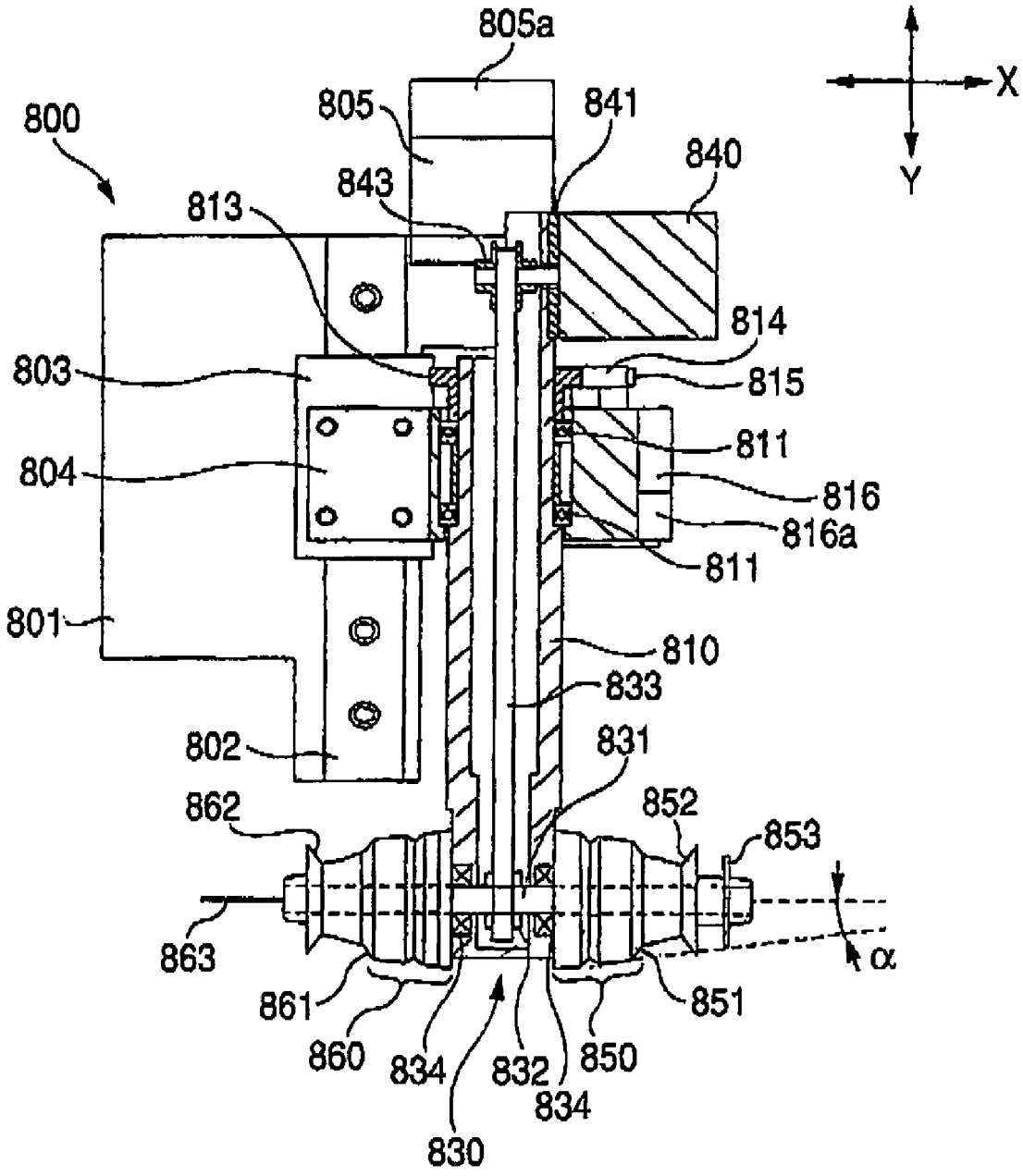
FIG. 9 is a sectional view of the processing unit of the sub processing apparatus.

The configuration of the processing unit 800 will be described with reference to FIGS. 8 and 9. FIG. 8 is a perspective view of the processing unit 800, and FIG. 9 is a sectional view of the processing unit 800.

A stationary plate 801 used as the base of the processing unit 800 is fixed to the mounting plate 573 of the movement unit 550 shown in FIG. 7. A rail 802 that extends back and forth (Y-direction) is attached to the stationary plate 801, and a slider 803 slides on the rail 802. A movement supporting base 804 is fixed to the slider 803 with screws. The movement supporting base 804 is moved in the Y direction as a ball screw 806 is rotated by a motor 805. An encoder 805*a* for detecting the position of movement in the Y direction is provided in the motor 805. Further, the origin position of the movement supporting base 804 in the Y direction is detected by a configuration of a photosensor and a light-shielding plate (not shown).

A movement supporting base 810 is rotatably journalled to the movement supporting base 804 by a bearing 811. Further, a gear 813 is fixed to the movement supporting base 810 on one side of the bearing 811. The gear 813 is connected to a gear 815 fixed to a rotary shaft of a pulse motor 816 attached to the movement supporting base 804 via an idle gear 814. By the rotation of the pulse motor 816, the movement supporting base 810 is rotated about the axis of the bearing 811.

A rotation unit 830 that holds a processing tool is attached to the tip of the rotation supporting base 810. The rotation angle of the rotation unit 830 is managed depending on the number of pulses to be output to the pulse motor 816. A rotary shaft 831 is rotatably held inside the rotation unit 830 by two bearings 834. A pulley 832 is attached to a central part of the rotary shaft 831. A motor 840 for rotating the rotary shaft 831 is fixed to a mounting plate 841 attached to the movement supporting base 810. A pulley 843 is attached to a rotary shaft of the motor 840. A belt 833 is hung between the pulley 832 and the pulley 843 inside the movement supporting base 810, and the rotation of the motor 840 in transmitted to the rotary shaft 831.

A conical small-diameter bevel-finishing grindstone 850 that has a V-groove for formation of a bevel and a flat processing surface, which is a bevel-finishing tool, a finishing-chamfering grindstone 851 for the front surface of a lens, a finishing-chamfering grindstone 852 for the rear surface of the lens that are chamfering tools, and a grooving cutter 853 (a grooving grindstone may be used) that is a grooving tool are attached coaxially attached to one end of the rotary shaft 831. On the other hand, a conical small-diameter bevel-polishing grindstone 860 that has a V-groove for formation of a bevel and a flat processing surface, which is a bevel-polishing tool, a polishing-chamfering grindstone 861 for the front surface of a lens, a polishing-chamfering grindstone 852 for the rear surface of the lens that are chamfering tools, and an end mill 863 that is a drilling tool are attached coaxially attached to the other end of the rotary shaft 831. The grindstones 850 and 860 have smaller diameters than those of the grindstones 151*b* and 151*c* of the main processing apparatus 1, and it is preferable that the diameters of bevel portions be 30 mm or less, for example, 20 mm. Although the grindstones 850 and 860 may be cylindrical it is preferable that the flat processing surfaces have tapered conical shapes. The angle $\alpha$ that is formed between the conical surface of the grindstone 850 or 860 and the axis of the rotary shaft 831 is about 8 degrees. Since the grindstones 850 and 860 have small diameters, bevel thinning (interference between a bevel-finishing grindstone and a bevel to be formed in a lens) can be suppressed even in a sharp bevel curve having a value greater than a curve value 6. Moreover, since the bevel-finishing grindstones have a conical surface (tapered surface), bevel thinning can be suppressed even in a sharper bevel curve. In addition, although only the grindstone 850 may be used for a simple configuration, it is preferable that other processing tools be axially attached. Further, the grindstones 850 and 860 may be cutters having a V-groove for formation of a bevel and a flat processing surface.

(C) Control System of Overall Processing System

Figure 10:
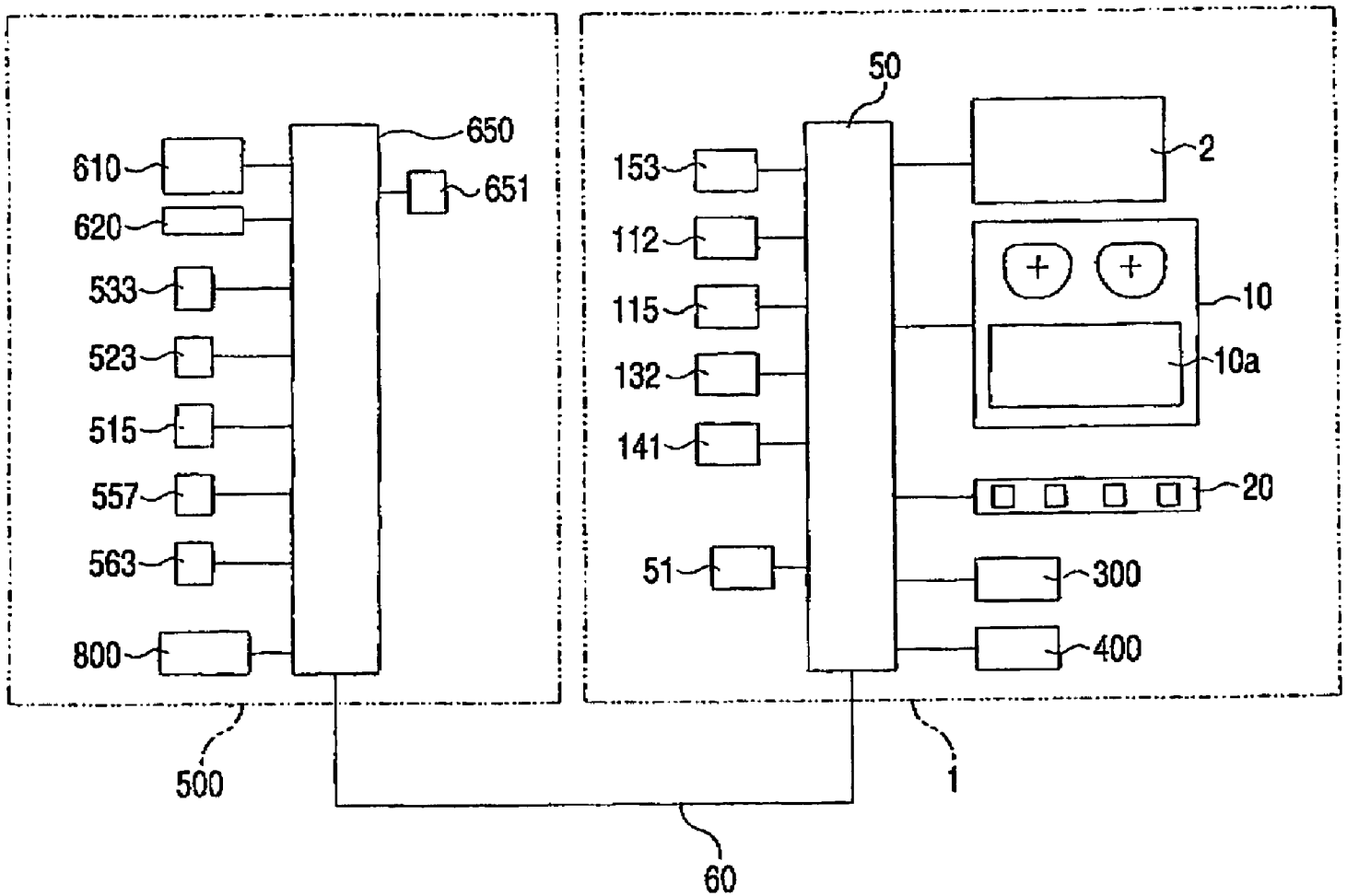
FIG. 10 is a perspective block diagram of a control system of the present eyeglass lens processing system.

FIG. 10 is a perspective block diagram of a control system of the processing system. The eyeglass frame measuring device 2, the display 10, the switch unit 20, the lens measuring unit 300, the chamfering unit 400, and the individual motors of the processing unit are connected to a control unit 50 of the main processing apparatus 1. Reference numeral 51 represents data memory. The display 610, the switch unit 620, the processing unit 800, the chamfering unit 800, and the individual motors that rotate a lens or move the processing unit 800 are connected to a control unit 650 of the sub processing apparatus 500. Reference numeral 651 represents data memory. The control unit 50 and the control unit 650 are connected by a communication cable 60 so that transmission and reception of data or command signals can be made mutually.

Next, the operation of the present system will be described. First, a case where bevel-finishing is performed will be described. The target lens shape data of the right and left lens frames measured by the eyeglass frame measuring device 2 is input to the data memory 51 by pushing a predetermined switch that is being displayed on the display 10. A diagram based on the right and left target lens shape data is displayed on the display 10, which allows layout data and processing conditions to be input. An operator inputs layout data, such as PD of a user, FPD, and the height of a geometrical center, and input conditions, such as the material of a lens to be processed, the material of a frame, a processing mode (bevel-finishing or flat-finishing), the existence or nonexistence of chamfering, the existence or nonexistence of polishing, and the existence or nonexistence of drilling, by a switch displayed on an input box 10*a* (refer to FIG. 10) of the display 10. Here, bevel-finishing is selected. At that time, if it is known that the frame curve of an eyeglass frame is large, a high bevel curve processing mode can be selected by a predetermined switch displayed on the input box 10*a*. If the high bevel curve processing mode is selected in advance, setting is made so that the grindstone 850 of the sub processing apparatus 500 may be used during bevel-finishing. When the grindstone 151*b* of the main processing apparatus 1 is used regardless of the frame curve of an eyeglass frame, a normal processing mode may be selected. In addition, if the chucking pressure when the lens LE is chucked by the lens chucks 111L and 111R of the main processing apparatus 1 is required to change in consideration of the thickness of a lens, the material of a lens, or crack of coating of a lens surface, the chucking pressure can be set weaker than a normal chucking pressure by a switch of the input box 10*a*. In addition, it is assumed that a lens for a right eye of a pair of right and left lenses is processed first. Whether any lens is to be processed is selected automatically or at the time of input.

When input of data required for processing is performed, an unprocessed lens LE will be chucked by the lens chucks 111L and 111R, and then a processing start switch of the switch unit 20 will be pushed to activate the apparatus. The control unit 50 first activates the lens measuring unit 300, and then the lens measuring unit measures the edge position of the lens corresponding to target lens shape data and layout data. Thereafter, the control unit 50 performs bevel calculation that obtains data of a path of a bevel to be formed in the lens LE on the basis of the edge position data according to a predetermined program. The bevel path data, for example, is obtained by arranging a bevel apex around the whole vector so that a edge thickness may be divided in a predetermined ratio. Moreover, the control unit 50 obtains an approximate bevel curve value Crv from the bevel path data. The bevel curve value Crv is obtained by assigning arbitrary four points of the bevel path data to an equation for a sphere to obtain the radius r of the sphere, and then obtaining a bevel curve value according to a well-known bevel curve value calculating expression from the radius r. The bevel curve value is displayed on the display 10. Here, if the bevel curve value Crv is 6 or more, the processing by the grindstone 850 of the sub processing apparatus 500 is set by the control unit 50. It the bevel curve value Crv is less than 6, the processing by the grindstone 151*b* of the main processing apparatus 1 is set by the control unit 50.

Next, a case where bevel-finishing is performed in the main processing apparatus 1 will be described. Here, the bevel path data is expressed as (En, θn, Zn) (where n=1, 2, . . . , N). En is a vector length (radius), and θn is a vector angle. Zn is a height with respect to a reference position in an axial direction of the lens chucks 111L and 111R. The bevel-finishing data is obtained by acquiring a processing point when the lens LE has been rotated on the basis of the radius Rb of the grindstone 151*b*, and calculating the center distance between the rotation center of the grindstone 151*b*, and the processing center of the lens LE (the center distance between the grindstone spindle 150 and the lens chuck 111L and 111R). Since this bevel-finishing data is calculated by a well-known method described in EP1510290A (European Patent Laid-Open No. 2005-74560), etc., the description thereof is omitted.

If the bevel-finishing data on the large-diameter bevel-finishing grindstone 151*b* is obtained, roughing data will be obtained from this. The roughing data is calculated as the data that is made large by a predetermined lens processing margin with respect to the bevel-finishing data. The control unit 50 controls driving of a motor that moves the carriage 110 and driving of a motor that rotates the lens, according to a processing sequence, and then the peripheral edge of the lens LE is roughed by the grindstone 151*a*. Thereafter, the control unit controls the movement of the carriage 110 and the rotation of the lens on the basis of the bevel-finishing data, and then, the peripheral edge of the lens LE is bevel-finished by the grindstone 151*b*. If the bevel curve value is small, the lens can be processed efficiently while bevel thinning is suppressed, by performing processing using the cylindrical larger-diameter bevel-finishing grindstone 151*b*.

In addition, when there is a designation for polishing, polishing is further performed by the grindstone 151*c*. Further, when there is a designation for chamfering, data on a chamfering path and its processing data are obtained on the basis of the edge position data. At the time of the chamfering, it is preferable to perform measurement of the edge position of a lens by the lens measuring unit 300 after the roughing. Since the deflection state of a lens by chucking may change before the roughing and after the roughing, a edge can be chamfered precisely by obtaining chamfering path data on the basis of edge position data after the roughing. The control unit 50 locates the grindstone spindle 430 of the chamfering unit 400 in a processing position after finishing, and controls movement of the carriage 110, etc. on the basis of chamfering data, thereby performing chamfering.

Next, a case where bevel-finishing is performed in the sub processing apparatus 500 will be described. As mentioned above, when the bevel curve value is 6 or more, or when a high bevel curve processing mode is first selected, setting is made by the control unit 50 so that the processing by the grindstone 850 of the sub processing apparatus 500 can be performed after roughing. The control unit 50 executes processing of the peripheral edge of the lens LE up to roughing based on roughing data, and then completes the processing by the main processing apparatus 1 without performing bevel-finishing (in addition, including even a case where the bevel-finishing is performed by the grindstone 151*b* in the main processing apparatus 1, leaving a bevel-finishing margin in the sub processing apparatus 500). Also, data required for calculation of the bevel-finishing data in the sub processing apparatus 500 (the edge position data obtained by the lens measuring unit 300, the bevel path data obtained on the basis of this edge position data, etc.), data on chucking pressure, etc. is transmitted to the sub processing apparatus 500. The chucking pressure data may be transmitted when a standard chucking pressure has been changed. Further, a message that the processing in the main processing apparatus 1 has been completed or a message that a lens should be moved to and processed by the sub processing apparatus 500 are displayed on the display 10.

If the operator has confirmed the completion of roughing in the main processing apparatus 1, the operator removes the lens LE chucked between the lens chucks 111R and 111L, and then attaches the cup 50 fixed to the roughed lens LE, to the cup holder 513 possessed by the lens chuck 511 of the sub processing apparatus 500 in a predetermined relationship. Thereafter, the lens LE is chucked by the lens chucks 511 and 512 by pushing a chuck switch of the switch unit 620 to allow the lens chuck 521 to descend. At this time, the control unit 650 controls driving of the motor 533 so that almost the same chucking pressure as the chucking pressure in the main processing apparatus 1 can be obtained. If the chucking pressure in the main processing apparatus 1 has a reference value, a standard chucking pressure that is stored in advance in the memory 651 is used. If the chucking pressure in the main processing apparatus 1 is changed, the data on the changed chucking pressure is transmitted, and thus this chucking pressure is used. In addition, the lens presser 525 is formed from the same member as the lens presser 121 of the main processing apparatus 1. Accordingly, the chucking conditions of the lens LE by the lens chucks 511 and 521 are almost the same as those in the main processing apparatus 1, and the deflection state of the lens is also almost the same as that in the main processing apparatus 1. As a result, bevel-finishing, chamfering, grooving, and drilling can be performed with high precision.

The data transmitted from the main processing apparatus 1 are stored in the memory 651. When a processing start switch of the switch unit 620 is pushed, the processing operation by the sub processing apparatus 500 is performed. First, the control unit 650 reads the bevel-finishing data transmitted from the main processing apparatus 1, and calculates data on bevel-finishing by the grindstone 850. The bevel path data calculated in the main processing apparatus 1 may be used as the bevel path data on which the bevel-finishing data is based. Moreover, edge position data, target lens shape data, layout data, etc. of the lens LE on which the bevel path data is based may be transmitted from the main processing apparatus 1, so that they may be calculated by the control unit 650.

Next, the operation of the bevel-finishing data in the sub processing apparatus 500 will be described. The center distance between the lens chucks 511 and 521 and the grindstone spindle 831 as the bevel-finishing data can be calculated similarly to the main processing apparatus 1 on the basis of the radius Rs of a bevel groove of the grindstone 850 (the same is true in the grindstone 860), if the rotation axes of both the lens chucks 511 and 521 and the grindstone spindle 831 are parallel to each other. As the bevel path data, (En, θn, Zn) (where n=1, 2, . . . , N) that is the same as that in the main processing apparatus 1 is used. However, since both the rotation axes are not parallel to each other when a processing surface of the grindstone 850 is conical, the bevel-finishing data is corrected on the basis of an inclination angle α. Further, when the grindstone spindle 831 is inclined at an angle α with respect to the lens chuck 511 or 521, the height data Zn in the lens chucking direction (height direction) is also corrected on the basis of the angle α. Since a method described in EP1510290A (JP-A-2005-74560) can be used for calculation and correction of the bevel-finishing data, the description thereof is omitted herein. In addition, only the data up to the bevel processing data may be obtained in the main processing apparatus 1, and then may be transmitted to the sub processing apparatus 500.

Figure 11:
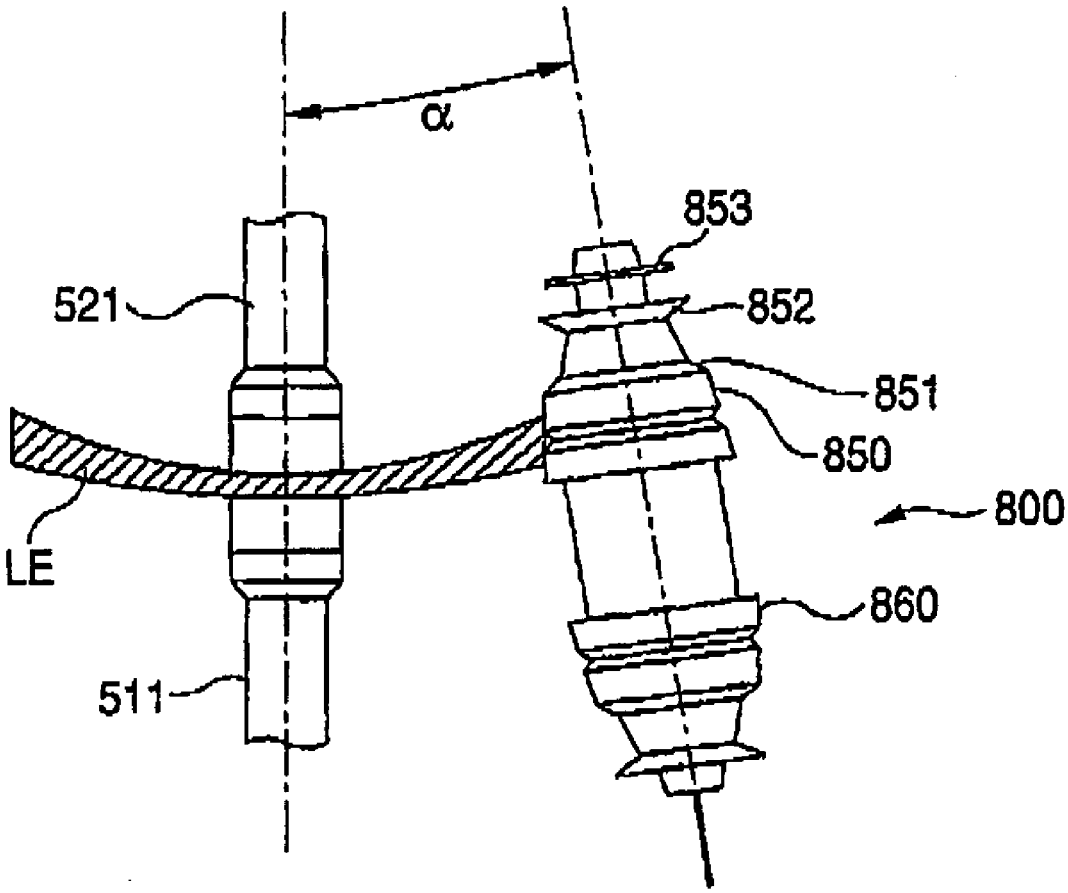
FIG. 11 illustrates bevel-finishing by a bevel-finishing grindstone having a small diameter.

If the bevel-finishing data that uses the small-diameter bevel-finishing grindstone 850 is obtained, the control unit 650 controls driving of each motor of the processing unit 800. Then, as shown FIG. 11, bevel-finishing is performed by pressing the grindstone 850 against the peripheral edge of the lens LE while changing the center distance of the rotary shaft 831 of the processing unit 800 with respect to the lens chucks 511 and 521 and rotating the lens LE. Since the grindstone 850 has a small diameter, the processing that any bevel thinning caused by interference is suppressed even in a sharp bevel curve can be performed. If the grindstone 850 has a conical surface, it is possible to comply with a sharper bevel curve.

When a designation for polishing is included in the data transmitted from the main processing apparatus 1, the control unit 650 performs bevel-polishing by the grindstone 860 after the bevel-finishing by the grindstone 850. Further, when a designation for chamfering is included in the data transmitted from the main processing apparatus 1, the edge position data by the lens measuring unit 300 is also transmitted simultaneously. The control unit 650 obtains data on a chamfering path on the basis of the edge position data, and calculates chamfering data by the grindstones 851 and 852. The data transmitted from the main processing apparatus 1 may be chamfering path data based on the edge position data. The control unit 650 controls driving of the processing unit 800, and then, edge corners of the front surface and rear surface of the lens after the bevel-finishing are chamfered by the grindstones 851 and 852. When this chamfering is performed, the chucking conditions are made almost the same as those of the main processing apparatus 1 as mentioned above. Thus, precise chamfering can be performed using the edge position data transmitted from the main processing apparatus 1, without providing a Coca position measuring unit in the sub processing apparatus 500.

While the peripheral edge of the lens LE for a right eye is processed by the sub processing apparatus 500 as described above, another lens LE for a left eye can be processed even in the main processing apparatus 101. An operator chucks the unprocessed lens LE for a left eye by the lens chucks 111L and 111R, and then pushes a processing start switch of the switch unit 20 to activate the apparatus. In the main processing apparatus 1, the processing up to the lens measurement and roughing of the lens LE is performed similarly to the above-mentioned case. For this reason, compared with a case where a plurality of lenses are processed only by the main processing apparatus 1, the whole processing time can be shortened.

Next, a case where the refractive surface of the lens LE is drilled will be described. Data required for drilling are input using an input function of the display 10 of the main processing apparatus 1. The target lens shape data can be used by calling the measurement data of a dummy lens measured by the eyeglass frame measuring device 2 or the data registered in advance in the memory 51. The layout data are input as data with the geometrical center of a target lens shape as the processing center. Further, after a drilling mode is designated by a switch displayed on the input box 10*a* of the display 10, a hole position editing screen is displayed on the display 10, and then the layout data of the hole position is input. The layout data of the hole position can be input as two-dimensional coordinate data on the basis of the geometrical center of a target lens shape.

If input of data required for processing has been completed, a processing start switch will be pushed to activate the apparatus, similarly to the above-mentioned case. The control unit 50 first activates the lens measuring unit 300, and then the lens measuring unit 300 measures the edge position of the lens corresponding to target lens shape data and layout data. Accordingly, the roughing data and finishing data are obtained. Further, the hole position on refractive surface of the lens is measured on the basis of the input hole position layout data, and the inclination of the lens refractive surface is measured. For example, when the front surface of a lens is drilled, the measurement stylus 307 possessed by the lens measuring unit 300 is located on the basis of the input two-dimensional coordinate data of the hole position, and the position information of the lens, which is detected by the encoder 331, in its height direction (in the lens chucking direction) is obtained. Further, the positions that are spaced apart by a predetermined distance (0.5 mm) in the direction of the vector length are measured from the two-dimensional coordinate data of the hole position. From the two measurement data, the inclination data of the lens refractive surface in a hole position is obtained by operation.

If the lens measurement is completed, roughing is carried out by the grindstone 151*a*, and subsequently flat-finishing is executed by the grindstone 151*b*. When there is a designation for polishing or chamfering, processing is performed by each grindstone possessed by the main processing apparatus 1 in this step. If the finishing is completed, the processing in the main processing apparatus 1 will be ended. Then, the message is displayed on the display 10, and the drilling data or basic data required for the arithmetic operation is be transmitted to the sub processing apparatus 500.

The data transmitted from the main processing apparatus 1 are stored in the memory 651. After an operator causes the lens LE whose peripheral edge has been processed to be chucked by the lens chucks 511 and 521 of the sub processing apparatus 500, the operator starts processing. The conditions, such as chucking pressure when the lens LE is chucked by the lens chucks 511 and 521, are made almost the same as those of the main processing apparatus 1. Accordingly, the edge position data obtained on the side of the main processing apparatus 1 can be used even in the sub processing apparatus 500.

Figure 12:
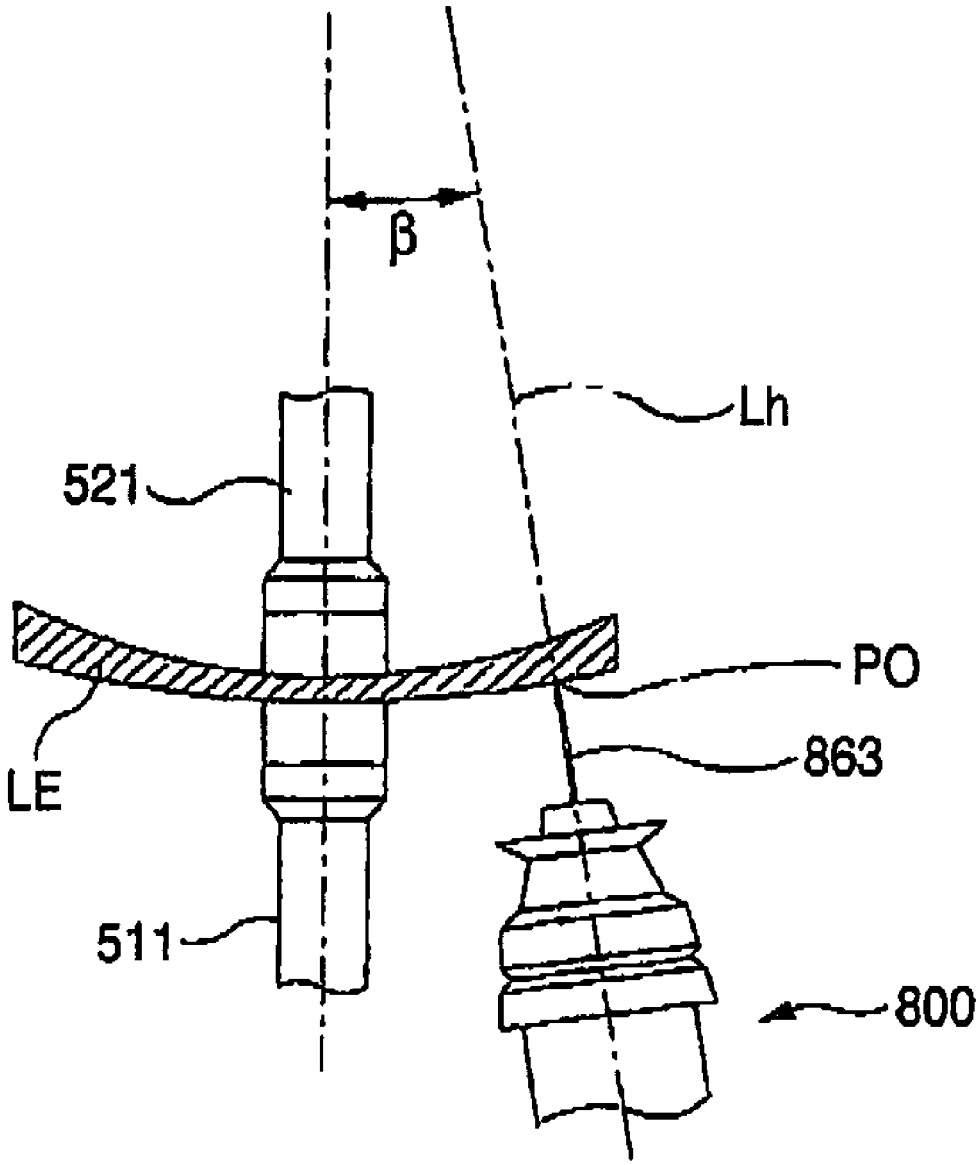
FIG. 12 illustrates drilling by an end mill.

Next, drilling in the sub processing apparatus 500 will be described. The control unit 650 obtains drilling data on the basis of the hole position layout data and the inclination data of the refractive surface, which are transmitted from the main processing apparatus 1. Then, the control unit 650 controls the operation of each motor of the processing unit 800 on the basis of the drilling data. As shown in FIG. 12, the end mill 863 coaxially attached to the rotary shaft 831 is located so that it may turn toward the front surface of the lens LE, and the angle β of the end mill 863 in its axial direction Lh is determined on the basis of the inclination angle of the refractive surface of the lens in a hole position P0. The axial direction Ln is a normal direction in the hole position PO of the refractive surface of the lens. Next, while the end mill 863 is rotated, the end mill 863 is moved in the axial direction Lh so that the tip of the end mill 863 may be located in the hole position P0 of the refractive surface of the lens. Accordingly, drilling can be performed in the hole position PO of the front surface of the lens.

While the lens LE for a right eye is drilled by the sub processing apparatus 500, another lens LE for a left eye can be processed even in the main processing apparatus 1. In the main processing apparatus 1, the processing up to the lens measurement and peripheral edge processing of the lens LE is performed similarly to the above-mentioned case. For this reason, compared with a case where a plurality of lenses are drilled by one apparatus, the whole processing time can be shortened.

Moreover, since the processing unit 800 of the sub processing apparatus 500 has the grooving cutter 853, it can also comply with grooving. For the groove path data at the time of grooving, the idea of calculating the bevel path data can be utilized basically. At the time of grooving, similarly to the case f the drilling, grooving may be performed by attaching the lens LE to the lens chucks 511 and 521 of the sub processing apparatus 500 after flat-finishing has been performed by the main processing apparatus 1. In that case, the groove path data or the lens edge position data on which the grooving processing data is based is transmitted to the sub processing apparatus 500, and the control unit 650 obtains grooving processing data to control the operation of the processing unit 800.

As such, it is possible to comply with bevel-finishing, drilling, etc. of a sharp bevel curve, by adding the sub processing apparatus 500 to a configuration in which the main processing apparatus 1 has a basic peripheral edge processing function like the related art. For this reason, various processing units can be made composite without complicating the internal configuration of the main processing apparatus 1. Further, since the lens measurement is made by using the lens measuring unit 300 possessed by the main processing apparatus 1 and the measurement data is utilized, the efficiency of the whole system can be improved. Further, the whole processing time when several lenses are processed can be shortened by performing bevel-finishing of a sharp bevel curve, drilling, grooving, etc. by the sub processing apparatus 500. Moreover, since the sub processing apparatus 500 is configured as an apparatus that is separate from the processing apparatus 1, a processing system to which the sub processing apparatus 500 is attached afterward can be realized without greatly remodeling the existing main processing apparatus 1 in terms of hardware. For this reason, a user who already has the main processing apparatus 1 having a basic configuration can comply with bevel-finishing of a sharp bevel curve, drilling, etc. with no need of purchasing a new whole apparatus.

What is claimed is:

1. An eyeglass lens processing system for processing an eyeglass lens, the system comprising:

a main processing apparatus comprising a first lens chuck that chucks the lens, a roughing tool, a first bevel-finishing tool, a lens edge measuring unit that obtains an edge position of the lens based on target lens shape data, and a first computing unit that calculates roughing data for controlling the roughing tool and calcualates first bevel-finishing data for controlling the first bevel-finishing tool; and a sub processing apparatus that is provided separately from the main processing apparatus and comprises a second lens chuck that chucks the lens, and a second bevel-finishing tool having a smaller diameter than the first bevel-finishing tool, wherein the main processing apparatus comprises:

a setting unit that sets whether processing of the lens is performed by the first or second bevel-finishing tool;

a transmission unit that, when processing by the second bevel-finishing tool is set, transmits to the sub processing apparatus at least one of second bevel-finishing data for controlling the second bevel-finishing tool or data for the sub-processing apparatus to calculate the second bevel-finishing; and a first control unit that, when processing by the first bevel-finishing tool is set, performs roughing based on the roughing data and bevel-finishing based on the first bevel-finishing data, and when the processing by the second bevel-finishing tool is set, performs only the roughing based on the roughing data, and wherein the sub processing unit comprises a second control unit that, when the processing by the second bevel-finishing tool is set, performs bevel-finishing based on the second bevel-finishing data.

2. The eyeglass lens processing system according to claim 1, wherein the transmission unit transmits at least one of data on the edge position or bevel path data based on the edge position data to the sub processing apparatus, and the sub processing apparatus comprises a second computing unit that calculates the second bevel-finishing data based on the data transmitted by the transmission unit.

3. The eyeglass lens processing system according to claim 1, wherein the transmission unit transmits chucking pressure data of the first lens chucks to the sub processing apparatus when the processing by the second bevel-finishing tool is set.

4. An eyeglass lens processing system for processing an eyeglass lens, the system comprising:

a main processing apparatus comprising a first lens chuck that chucks the lens, a roughing tool, a bevel-finishing tool, a flat-finishing tool, a lens edge measuring unit that obtains an edge position of the lens based on target lens shape data, and a first computing unit that calculates roughing data for controlling the roughing tool, bevel-finishing data for controlling the bevel-finishing tool, and flat-finishing data for controlling the flat-finishing tool; and a sub processing apparatus that is provided separately from the main processing apparatus and comprising a second lens chuck that chucks the lens and a drilling tool, wherein the main processing apparatus comprises:

a setting unit that sets whether or not drilling of the lens is performed;

a transmission unit that, when it is set that the drilling is performed, transmits to the sub processing apparatus at least one of drilling data for controlling the drilling tool or data for the sub processing apparatus to calculate the drilling data; and a first control unit that, when it is set that the drilling is performed, performs roughing based on the roughing data and flat-finishing based on the flat-finishing data, and wherein the sub processing unit comprises a second control unit that, when it is set that the drilling is performed, performs the drilling based on the drilling data.

5. The eyeglass lens processing system according to claim 4, wherein the transmission unit transmits chucking pressure data of the first lens chucks to the sub processing apparatus when it is set that the drilling is performed.

* * * * *